United States Patent [19]

de la Burde et al.

[11] 4,202,357

[45] May 13, 1980

[54] REORDERING EXPANDED TOBACCO BY WATER MIST

[75] Inventors: Roger Z. de la Burde, Powhatan; Patrick E. Aument, Hopewell; Francis V. Utsch, Chester, all of Va.

[73] Assignee: Philip Morris Incorporated, New York, N.Y.

[21] Appl. No.: 955,359

[22] Filed: Oct. 27, 1978

[51] Int. Cl.[2] ..... A24B 3/04; A24B 3/12; A24B 3/18

[52] U.S. Cl. ..... 131/140 R; 131/133 R; 131/138; 131/140 P

[58] Field of Search ..... 131/140 P, 136, 138, 131/133 R, 140 R, 134, 135, 137, 140 P; 426/445–450

[56] References Cited

U.S. PATENT DOCUMENTS

| | | | |
|---|---|---|---|
| 3,214,928 | 11/1965 | Oberdorfer | 131/140 P |
| 3,524,452 | 8/1970 | Moser | 131/140 P |
| 3,612,066 | 10/1971 | Jones | 131/140 P |
| 4,004,594 | 1/1977 | Wochnowski et al. | 131/135 |
| 4,161,953 | 7/1979 | Glock | 131/140 P |

*Primary Examiner*—V. Millin

*Attorney, Agent, or Firm*—Watson, Leavenworth, Kelton & Taggart

[57] ABSTRACT

A process for rapidly and uniformly reordering tobacco material which has been subjected to an expansion treatment is disclosed. The process comprises spraying the tobacco material with a fine water mist characterized by an average droplet size of between about 1 and 120 microns diameter.

7 Claims, No Drawings

REORDERING EXPANDED TOBACCO BY WATER MIST

BACKGROUND OF THE INVENTION

Many processes for the expansion of tobacco involve exposure of the tobacco to conditions which result in a low-moisture level in the expanded tobacco. Generally, tobacco which is obtained from an expansion process will have below about 6% moisture content and often less than 3% moisture content. Thus, when tobacco has been expanded, the resulting filler (tobacco) is much dryer than desired for further processing or use. Therefore, to avoid breakage and to insure satisfactory smoking qualities, expanded tobacco material must be reordered (rehumidified) to a moisture level in equilibrium with normal use conditions before it may be handled and processed. Typically, and as defined herein, standard conditions are 60% relative humidity and 24° C. Tobacco which has not been subjected to expansion conditions will often equilibrate to about 12% moisture at these standard conditions. Tobacco leaf which has undergone an expansion treatment accompanied by severe drying will equilibrate to a somewhat lower moisture level, such as 11%. This is a suitable target level for reordering.

Many means for reordering or rehumidifying tobacco have been used. Common practice has included two relatively rapid time-saving processes. The first, direct reordering, is accomplished simply by subjecting the expanded tobacco product to a water spray. A second method has involved exposure of the expanded tobacco material to saturated steam. Neither the direct nor the high-temperature method has been found to be completely satisfactory with expanded tobacco leaf, because of undue shrinkage of the expanded filler. Both elevated temperatures and direct contact with liquid water tended to cause collapse of the leaf structure toward the unexpanded state. Accordingly, there is a significant loss of filling power, with decreased benefit being derived from the expansion treatment, when such rapid reordering methods are employed.

One method which has been employed in order to avoid these difficulties has involved room temperature equilibration of expanded tobacco with air at or slightly above the desired humidity level. This procedure typically has been found to be slow, requiring from 24 minutes to a day or longer to bring the product to the desired condition.

An example of one such prior art humidifying procedure involves drawing air at 60% relative humidity and room temperature through expanded, dry tobacco for 8 to 24 hours. However, the prolonged equilibration periods required make these equilibration methods somewhat unsatisfactory for commercial practice. In addition, the product resulting from such procedures has been found to exhibit a non-uniform moisture content, generally from 8 to 16%, apparently due to uneven exposure of tobacco to the flowing air.

Forced air circulating systems have been designed to overcome the problems of the above equilibration methods. However, these systems require major capital expenditures and still require fairly prolonged equilibration times. For example, where one such system, a Proctor and Schwartz unit, is employed, it has been found that humid air must be drawn through the bed of tobacco for a period of 24 to 40 minutes to achieve satisfactory rehumidification.

In addition to the above-noted problems encountered in equilibration methods, a fire hazard may exist in some forced air units currently employed to reorder tobacco material. This is due to the fact that occasionally burning or smoldering material is introduced into the reordering unit as a result of the design of the expansion unit employed. The forced air blowing through the filler fans these particles into flame. This can result in long down times for the unit, as well as lost product.

Unexpectedly, it has been discovered that a superior reordered product can be obtained rapidly by means of the process described herein. The product of the instant process exhibits relatively little shrinkage toward the original unexpanded state and has a relatively more uniform moisture level. In addition, the present process results in reduced processing times and space savings due to the requirement for smaller equipment, eliminates costly air handling and conditioning equipment, and eliminates the fire hazard encountered in some reordering methods.

BRIEF SUMMARY OF THE INVENTION

A process whereby relatively dry tobacco material which has been expanded can be uniformly reordered rapidly and without loss of bulk, is provided. In accordance with the invention, expanded tobacco material is rehumidified by spraying with a fine water mist, the average droplet size of which is less than 120 microns in diameter, and preferably 20–60 microns. The process may be effected in a flighted rotary cylinder at ordinary temperatures in about 1 to 4 minutes.

DETAILED DESCRIPTION OF THE INVENTION

This invention relates to a means for reordering tobacco rapidly and without damage to the shreds. Broadly, the process comprises contacting relatively dry tobacco which has been subjected to an expansion treatment, with a fine water spray, the droplets of which are of specific, controlled size. By means of the process, rapid and relatively uniform remoisturizing of the tobacco is effected simply and inexpensively, with minimal shrinkage toward the unexpanded state.

In accordance with the invention, the tobacco which has been subjected to an expansion treatment, is treated with a water fog or mist characterized by an average droplet size of less than about 120 microns diameter, and preferably 20 to 60 microns diameter. Typically the output of an expansion treatment contains less than 6% moisture content measured as oven volatiles (OV) as hereinafter defined, but may contain from less than 1% to the normal 12% moisture content. By means of the present reordering method, acceptable moisture levels for such expanded tobacco material may be achieved in 1 to 4 minutes at ordinary room temperature without undue shrinkage or collapse of the tobacco toward the unexpanded state.

It has been found that by maintaining the average droplet size of the water spray below about 120 microns during reordering, shrinkage of the expanded tobacco may be reduced. Droplets above that 120 micron size and agglomeration of water on the surface of tobacco particles cause collapse of the expanded tobacco structure. In addition, reordering to moisture contents of less than 20% reduces the degree of irreversible shrinkage in the expanded tobacco. It is preferable to limit reordering to less than 15% and best results are obtained in the tobacco material reordered to a moisture content at or below the normal equilibration moisture content of expanded filler, that is, 10.5 to 12%.

There are several means for generating water fogs or mists of the particle size required for the practice of the instant method. The oldest and best known uses high air pressure; the air forces liquid through a small orifice under high pressure. The liquid-air stream exits at the nozzle tip at high velocity. A typical particle size range is from 5 to 120 microns, and the air flow takes care of distributing the mist. A suitable spray may be obtained with the 1/4 JCO Pneumatic Atomizing Nozzles of Spraying Systems Co. or one of their fluid nozzles combined with an air nozzle. High pressure water atomizing nozzles, which operate at 100–1000 psig or more and utilize no air, can also be used.

Sonic atomization utilizes the energy in sound waves to break up particles. Compressed air passing through the convergent-divergent inner bore of a nozzle creates a high frequency pressure wave in a resonator. The energy waves are reinforced by shock waves that radiate from the resonator; an intense energy field is built up between the nozzle exit and the resonator. Water pumped or sucked into this field is atomized uniformly into fine droplets having low forward velocity. Typical particle sizes are 10 to 25 microns. Suitable sonic generators include the "Sonicore" atomizers.

Ultrasonic aerosol generation can produce particles from 20 microns or larger to less than 1 micron. The principle is periodic excitation of a body of water by an acoustical wave to form standing waves on the surface, which become unstable and discharge droplets. These generators are generally more expensive than the other two discussed. With nonpneumatic generators, such as the sonic or ultrasonic type, an air flow or the like is required to carry the mist away from the generator and prevent agglomeration of water particles on the expanded tobacco.

Expanded tobacco may be treated with the requisite water spray by feeding the tobacco into a chamber in a layer and directly spraying the layer, commonly at 30°–50° C. above ambient. A suitable treating chamber for practicing the present method is a rotary cylinder. One with lifting flights is preferable to provide for good, uniform exposure and steady conveyance of tobacco shreds through the chamber. The cylinder may be equipped with atomizing spray heads or other suitable means of delivering a spray mist with particles in the range of 1 to 120 microns. In order to minimize breakage of the tobacco material during reordering, it is preferable to raise the moisture content quickly by having the first few nozzles in such a system provide a significant amount of the total water spray.

The amount of water added in practicing the present reordering method is dependent on the moisture of the input tobacco material, the desired final product moisture, which is generally between about 9 to 14%, and the percent retention of added water as determined from previous operating experience or by using suitable moisture measuring devices. The necessary period of exposure to the water spray and the rate of water discharge to achieve a desired moisture content can be determined by simple calibration runs. The rate of spray application is generally set to bring the delivery to about 5 to 50% more than is calculated as necessary to bring the tobacco to the desired moisture level.

In general, the present rapid reordering process produces moisture levels in expanded material in 1 to 4 minutes that are equivalent to those reached in 18 to 24 hours in a humidity-controlled cabinet or in the commercially-used treating chamber in 24 to 60 minutes with only slight or no sacrifice in bulk volume (0 to 3 units) measured as CV. Expanded tobacco material reordered in accordance with the present method exhibits very little difference in breakage as measured by distribution among sizes in standard sieve tests before and after treatment by different methods. Moreover, the resultant filler exhibits no significant differences from commercial blends in terms of smoking, firmness and chemical properties.

The advantages of the present invention include reduction in processing time, supplies and smaller equipment used in processing, elimination of costly air handling and conditioning equipment, and more uniformity in the resulting product.

Another advantage of the present invention is the ability of the reordering machine to eliminate the fire hazard that may exist in the currently-used forced-air units. By means of the water spray burning particles received in the reordering unit from the expansion system are quenched. Thus, the present reordering system overcomes the problems of long down time, and lost products which can result from fires encountered in some reordering procedures.

As used herein, % moisture may be considered equivalent to oven volatiles (OV) since not more than about 0.9% of the tobacco weight is volatiles other than water. Oven volatiles determination is a simple measurement of weight loss on exposure in a circulating air oven for three hours at 100° C.

As described herein, the degree of expansion of tobacco is measured in terms of cylinder volume. Cylinder Volume (CV) is determined as follows: Tobacco filler weighing 10.000 g is placed in a 3.358-cm diameter cylinder, vibrated for 30 seconds on a "Syntron" vibrator, and compressed by a 1875-g piston 3.335-cm in diameter for 5 minutes and the resulting volume of filler is reported as cylinder volume. This test is carried out at standard environmental conditions of 23.9° C. and 60% RH; conventionally unless otherwise stated, the sample is preconditioned in this environment for 18 hours. This value depends on the moisture content (OV). In order to bring slightly different OV materials to a comparable basis, the CV value may be adjusted to some specified oven-volatile content, according to the following formula:

Corrected CV or $CCV = CV + F(OV - OV_s)$ where $OV_s$ is the specified OV and F is a correction factor (volume per %) predetermined for the particular type of tobacco filler being dealt with. CV and CCV are expressed in cc/10 grams. The method for cylinder volume measurement is described in Wakeham et al., "Filling Volume of Cut Tobacco and Cigarette Hardness," *Tobacco Science,* Volume XX, pages 157–160 (1976), the disclosures of which are incorporated herein by reference.

In order to bring differing OV materials to a comparable basis, CV values herein have been arbitrarily corrected to a common basis of 11.0% OV. This is done by applying a predetermined correction factor of 7.5 per percent OV as follows:

$$CCV = CV + (\%OV - 11.0)7.5$$

Unexpanded product would, of course, be uncorrected or corrected to a higher OV level appropriate to untreated tobacco.

Unless otherwise indicated, all percentages used herein are by weight.

The following examples are illustrative:

EXAMPLE 1

To determine the effect of spray water droplet size on the filling power of reordered tobacco, several experiments were conducted. Known amounts of dry expanded filler were tumbled in plastic bags into which controlled amounts of water of known droplet size were sprayed. Two different types of air and water nozzles were used. Droplet size was controlled by air pressure and the averages ranged from 20–250 microns.

A. NOZZLES (AIR #70, WATER #2050 - SPRAYING SYSTEMS, INC.)

| Average Droplet Size Microns | % Input OV | % Moistened OV | cc/10g CV | cc/10g at 11% OV CCV |
|---|---|---|---|---|
| 20 | 3.2 | 11.8 | 81 | 87 |
| 30 | 2.8 | 12.1 | 80 | 88 |
| 40 | 2.9 | 11.2 | 86 | 87 |
| 60 | 3.1 | 11.0 | 84 | 84 |
| 120 | 3.2 | 11.4 | 78 | 81 |
| 150 | 3.8 | 11.8 | 58 | 64 |
| 200 | 3.4 | 11.6 | 48 | 53 |
| 250 | 3.2 | 11.7 | 48 | 53 |

B. NOZZLES (AIR #64, WATER #1650)

| Average Droplet Size Microns | % Input OV | % Moistened OV | cc/10g CV | cc/10g at 11% OV CCV |
|---|---|---|---|---|
| 20 | 2.8 | 11.4 | 84 | 87 |
| 30 | 3.2 | 11.3 | 84 | 87 |
| 50 | 3.2 | 12.0 | 80 | 88 |
| 60 | 3.3 | 11.9 | 76 | 83 |
| 90 | 3.1 | 11.8 | 73 | 79 |
| 120 | 3.0 | 11.2 | 75 | 77 |
| 140 | 2.8 | 10.8 | 63 | 62 |
| 200 | 3.0 | 11.1 | 54 | 55 |

The results indicate that the shrinkage of the expanded filler is related to droplet size. Shrinkage is minimized when the average droplet size is kept below 120 microns. Even greater reduction in shrinkage is observed with average droplet size below 60 microns.

EXAMPLE 2

Using the 40 micron spray setting as in Example 1, another series of tests were conducted in which the amount of water added to dry expanded filler was varied from 8 to 61% by weight. Filling power (CV) measurements were taken of the moisturized filler and of the same filler sample re-equilibrated at 21° C. and 60% RH for 18 hours. The results of these tests are set forth below:

| Test | Dry Filler % OV | Moisturized Filler % OV | Moisturized Filler CV cc/10g | CCV,cc/10g corrected 11% OV Re-Equilibrated Filler |
|---|---|---|---|---|
| 1 | 3.2 | 8.0 | 102 | 85 |
| 2 | 3.2 | 9.3 | 99 | 84 |
| 3 | 3.2 | 10.1 | 93 | 82 |
| 4 | 3.4 | 10.8 | 87 | 83 |
| 5 | 2.8 | 12.3 | 76 | 83 |
| 6 | 2.8 | 14.9 | 50 | 78 |
| 7 | 2.8 | 18.0 | 38 | 76 |
| 8 | 2.6 | 22.8 | 35 | 52 |
| 9 | 2.8 | 28.6 | 24 | 40 |
| 10 | 2.6 | 40.0 | 20 | 40 |
| 11 | 2.2 | 56.0 | 18 | 38 |
| 12 | 2.2 | 61.6 | 16 | 36 |

The results indicate that addition of water to yield tobacco material having above 20% moisture content causes irreversible shrinkage of the expanded filler. Reduced shrinkage is effected when reordering by water spray if the moisture content of the reordered expanded filler is limited to less than 20% and more preferably to below 15%. Best results are observed where the reordered filler has a moisture content at or below the normal equilibration moisture content of expanded filler, i.e., 10.5 to 12%.

EXAMPLE 3

Commercial cigarette filler which had been expanded by the method disclosed in U.S. Pat. No. 3,771,533 to Armstrong was fed directly from the expansion unit output into one of two reordering units. The first was a horizontal rotating cylinder 12 feet long and 3 feet in inside diameter supplied with 8 straight, longitudinal, equally-spaced flights 6 inches in height. Nine air-atomized water spray nozzles, model 1/4 JCO (Spraying Systems Company), were installed along the length of the cylinder interior at equal spacing. The nozzles were operated to produce a mist of 40 microns diameter with water flow being 74.2 pounds/hour (7.2 gallons/hour through the first 5 nozzles from the entrance and 1.7 gallons/hour through the remaining 4). By having the first 5 nozzles provide about 80% of the water, moisture content is quickly raised and filler breakage is reduced. Filler output was 720 pounds/hour with cylinder rotation at 5¾ rpm. Holding time was 3 minutes. It is estimated that 79% of the water was retained by the product.

For comparison, the second was a drier type reordering unit operated in parallel with the spray mist system. A Proctor & Schwartz reordering apparatus supplied air at 68% RH and 24° C. A five hour comparison test was run on freshly expanded tobacco filler as received from the vertical expansion tower at 3.9% OV. Table 1 gives comparative results for the two methods of reordering with respect to product characterization, sieve analysis, and standard deviations. The results indicate that the process of the invention shows less variability than the conventional process used for comparison.

Table I

| | | | | Rapid Reordering Test | | | | | | |
|---|---|---|---|---|---|---|---|---|---|---|
| Sample Location | No. Tests | Average OV, % | Standard Deviation | Corrected CV cc/10 g | Standard Deviation | % Longs | % Mediums | % Shorts | % Smalls | % Fines |
| Before Rapid Reordering Cylinder | 8 | 3.90 | 0.43 | — | — | 36.68 | 48.20 | 12.16 | 2.05 | 0.91 |

Table I-continued

| Sample Location | No. Tests | Average OV, % | Standard Deviation | Corrected CV cc/10 g | Standard Deviation | % Longs | % Mediums | % Shorts | % Smalls | % Fines |
|---|---|---|---|---|---|---|---|---|---|---|
| | | | | Rapid Reordering Test | | | | | | |
| Before Conventional Reordering System | 7 | 3.61 | 0.45 | — | — | 41.51 | 46.66 | 9.46 | 1.52 | 0.85 |
| After Rapid Reordering Cylinder | 21 | 11.73 | 0.69 | 79.5 | 5.8 | 32.68 | 51.76 | 12.61 | 2.20 | 0.75 |
| After Conventional Reordering System | 21 | 11.07 | 1.59 | 82.9 | 11.1 | 41.31 | 47.83 | 8.50 | 1.60 | 0.75 |

EXAMPLE 4

Cigarette filler blend has been expanded by the method disclosed in U.S. application Ser. No. 441,767 and was fed directly from the expansion unit output at less than 3% OV into one of three reordering units. The first was a conventional drier supplied with air at 24° C./60% r.h. flowing at 100 feet/second as previously used for the reordering process. The second was a conditioning cabinet supplied with air at 60% r.h. and 21° C. over the material spread in trays at a depth of 4 inches. The third was a rotary cylinder prepared for practice of the present invention with 12 longitudinal 8-inch high straight flights to tumble and distribute the filler; 18 water-atomizing nozzles, model 1/4 J (Spraying Systems Company), were installed at 1-foot intervals along a line 15 inches from the center line of the cylinder and operated at 40 psig water/40 psig air to produce an average droplet size of 40 microns. The water discharge rate was 500 pounds/hour and the residence time for product being treated was one minute by prior calibration. Three operating periods were followed as Tests I, II, and III. Table II compares CV values and Table III indicates sieve analysis results.

Table II

| | CV Comparison Conventional Drier vs. Rapid Reordering | | |
|---|---|---|---|
| | Test I | Test II | Test III |
| CCV from Drier | | | |
| cc/10 grams | 77.6 | 81.1 | 77.9 |
| Percent OV | 11.0 | 10.7 | 11.9 |
| CCV from Rapid Reordering | | | |
| cc/10 grams | 77.3 | 78.0 | 78.3 |
| Percent OV | 11.4 | 11.3 | 10.5 |
| Humidity Cabinet | | | |
| 24-hour Reordered | 75.8 | 82.5 | 76.8 |
| Percent OV | 11.3 | 10.7 | — |
| CCV Results Averaged | | | |
| Drier | 78.8 | | |
| Cylinder (Rapid Reordered) | 77.8 | | |

Table II-continued

| | CV Comparison Conventional Drier vs. Rapid Reordering | | |
|---|---|---|---|
| | Test I | Test II | Test III |
| 24-hour Reordered | 78.3 | | |

Table III

| Sieve Test | Average OV, % | Long % | Medium % | Short % | Small % | Fine % |
|---|---|---|---|---|---|---|
| | Sieve Fraction Comparison Conventional Drier vs. Rapid Reordering | | | | | |
| 1 Rapid | | | | | | |
| Reordered | 11.4 | 34.2 | 52.1 | 10.8 | 1.3 | 1.5 |
| Drier | 11.0 | 35.9 | 52.0 | 9.8 | 1.3 | 1.0 |
| Cabinet | 11.3 | 34.4 | 52.8 | 9.9 | 1.6 | 1.4 |
| 2 Rapid | | | | | | |
| Reordered | 11.3 | 35.8 | 51.6 | 10.0 | 1.4 | 1.2 |
| Drier | 10.7 | 38.6 | 50.9 | 8.4 | 1.2 | 0.8 |
| Cabinet | 10.7 | 35.1 | 51.6 | 9.9 | 1.8 | 1.5 |
| 3 Rapid | | | | | | |
| Reordered | 10.5 | 33.2 | 54.4 | 10.1 | 1.3 | 1.1 |
| Drier | 11.9 | 41.2 | 49.5 | 7.7 | 0.9 | 0.7 |
| Cabinet | — | 37.3 | 51.1 | 8.8 | 1.5 | 1.3 |
| Average | | | | | | |
| Rapid | | | | | | |
| Reordered | 11.1 | 34.4 | 52.7 | 10.3 | 1.3 | 1.3 |
| Drier | 11.2 | 38.6 | 50.8 | 8.6 | 1.1 | 0.8 |
| Cabinet | 11.0 | 35.6 | 51.3 | 9.5 | 1.6 | 1.4 |

EXAMPLE 5

Freshly expanded tobacco filler from the expansion tower having 3.5% OV, was fed directly into one of two reordering units. The first was a conventional drier unit as in Example 3. The second was a rotary cylinder as used in Example 4, in which the first six nozzles were adjusted to supply 40% of the water in order to quickly raise the moisture level. The expanded filler throughput was set at 4,400 lbs/hour, the cylinder was operated at 6 rpm's and the average droplet size was 40 microns. The results of these tests are shown in Table IV.

TABLE IV

| Test No. | REORDERING MACHINE % OV | CV-cc/10 g | CCV-cc/10 g | CONDITIONING CYLINDER % OV | CV-cc/10 g | CCV-cc/10 g |
|---|---|---|---|---|---|---|
| | SUMMARY OF TEST DATA | | | | | |
| 10-14 | 10.92 | 80.9 | 80.1 | 10.90 | 80.4 | 79.3 |
| 10-24 | 10.42 | 89.2 | 81.9 | 11.01 | 81.8 | 81.9 |
| 10-25 | 11.03 | 74.3 | 74.6 | 10.56 | 85.4 | 80.7 |
| 11-1 | 11.00 | 79.0 | 79.0 | 11.54 | 75.3 | 80.8 |
| 11-2 | 10.84 | 75.5 | 73.9 | 11.19 | 78.2 | 80.2 |

| Test No. | Sieves, % Long | Med. | Short | Small | Fine | Sieves, % Long | Med. | Short | Small | Fine |
|---|---|---|---|---|---|---|---|---|---|---|
| 10-14 | 36.99 | 48.04 | 12.00 | 2.10 | 0.87 | 38.38 | 45.08 | 13.33 | 2.25 | 0.96 |
| 10-24 | 36.86 | 49.26 | 10.76 | 2.03 | 1.09 | 39.44 | 46.01 | 11.46 | 2.16 | 0.93 |
| 10-25 | 32.68 | 50.58 | 13.42 | 2.36 | 0.95 | 39.12 | 46.03 | 12.12 | 1.94 | 0.79 |
| 11-1 | 35.64 | 49.00 | 12.36 | 2.19 | 0.81 | 39.29 | 46.29 | 11.74 | 1.95 | 0.73 |

TABLE IV-continued

| | | | | | | | | | | |
|---|---|---|---|---|---|---|---|---|---|---|
| 11-2 | 36.94 | 49.05 | 11.27 | 2.05 | 0.69 | 40.21 | 45.40 | 11.78 | 1.86 | 0.75 |

EXAMPLE 6

Filler from the equipment as described in Example 5 was incorporated into a cigarette blend at 6, 15 and 25% levels and made into cigarettes. Compacimetric, subjective and chemical comparisons were made. No differences in the smoking, firmness or chemical properties of the cigarettes were noted when compared to commercial expanded tobacco. The results are summarized in Tables V and VI.

TABLE V

| | COMPACIMETRIC TESTS Firmness (Wt. in Grams at 30) | | |
|---|---|---|---|
| % Level Of Addition | P & S | Rotary Cylinder | % Difference* |
| 6 | 0.748 | 0.753 | 0.67 |
| 15 | 0.729 | 0.727 | 0.27 |
| 25 | 0.704 | 0.712 | 1.14 |

*Less than 3% difference is not significant

TABLE VI

| | SUBJECTIVE TESTS (15% Addition Level) Preference* | | |
|---|---|---|---|
| | P & S | Rotary Cylinder | No Difference |
| Percent of Test Subjects | 39.5 | 37.0 | 23.5 |

*There is no significant difference.

EXAMPLE 7

Because of the design of the expanding unit, occasionally burning filler is introduced into the reordering unit. In the currently used Proctor and Schwartz unit, the necessary blowing of forced air through the tobacco bed fans these filler particles into flame resulting in long down time and lost production. To test the ability of the fine water mist of the current invention to quench the burning particles, three runs were made in which 15 lbs. of smoldering expanded filler were introduced into the rotary cylinder while operating as in Example 5. The results of these runs are listed below:

Run 1—No burning particles at discharge
Run 2—No burning particles at discharge
Run 3—No burning particles at discharge These results indicate that the cylinder reordering unit is an effective means of reducing the fire hazards that occur in the currently used Proctor and Schwartz unit.

What is claimed is:

1. A process for reordering expanded tobacco comprising spraying the expanded tobacco with a fine water mist characterized by an average droplet size of less than about 120 microns diameter.

2. The process of claim 1 wherein the average droplet size is between about 20 to 60 microns.

3. The process of claim 1 wherein the tobacco is sprayed in a rotary cylinder having lifting flights.

4. The process of claim 1 wherein the spray is generated by forcing liquid through a small orifice under high pressure.

5. The process of claim 1 wherein the spray is generated by means of high pressure water atomizing nozzles.

6. The process of claim 1 wherein the spray is generated by means of sonic atomization.

7. The process of claim 1 wherein the spray is generated by means of an ultrasonic generator.

* * * * *